US011655129B2

(12) United States Patent
Benz

(10) Patent No.: US 11,655,129 B2
(45) Date of Patent: May 23, 2023

(54) LIFTING PLATFORM

(71) Applicant: Gerhard Finkbeiner, Freudenstadt (DE)

(72) Inventor: Dieter Benz, Alpirsbach (DE)

(73) Assignee: Gerhard Finkbeiner, Freudenstadt (DE)

( * ) Notice: Subject to any disclaimer, the term of this patent is extended or adjusted under 35 U.S.C. 154(b) by 453 days.

(21) Appl. No.: 16/603,455

(22) PCT Filed: Apr. 10, 2018

(86) PCT No.: PCT/EP2018/059088
§ 371 (c)(1),
(2) Date: Oct. 7, 2019

(87) PCT Pub. No.: WO2018/189139
PCT Pub. Date: Oct. 18, 2018

(65) Prior Publication Data

US 2021/0087030 A1 Mar. 25, 2021

(30) Foreign Application Priority Data

Apr. 13, 2017 (DE) ..... 102017108069.4

(51) Int. Cl.
*B66F 7/28* (2006.01)
*B66F 7/06* (2006.01)

(52) U.S. Cl.
CPC ..... *B66F 7/28* (2013.01); *B66F 7/065* (2013.01)

(58) Field of Classification Search
CPC ..... B66F 7/28; B66F 7/065; B66F 7/0625
See application file for complete search history.

(56) References Cited

U.S. PATENT DOCUMENTS 4,287,965 A * 9/1981 Pearson ..... B66F 7/28 187/219
4,776,569 A * 10/1988 Nestel-Eichhausen ... B66F 7/02 254/133 R (Continued)

FOREIGN PATENT DOCUMENTS

CN 203612891 U * 5/2014
CN 105967100 A * 9/2016 ..... B25H 1/0007

(Continued)

OTHER PUBLICATIONS

International Search Report and Written Opinion for corresponding Patent Application No. PCT/EP2018/059088 dated Jul. 23, 2018.

*Primary Examiner* — Michael R Mansen
*Assistant Examiner* — Michelle M Lantrip
(74) *Attorney, Agent, or Firm* — Renner, Otto, Boisseile & Sklar, LLP

(57) ABSTRACT

The invention relates to a lifting platform for lifting vehicles, with two base assembly halves (14) with in each case one lifting device (24) arranged on the base assembly half (14), which includes a load arm (25) and a guiding arm (27), which arms, by means of at least one drive, are pivotably transferable out of a starting position arranged on the floor into an operating position (32), and which comprises a carrier (31) in in each case one end region of the lifting device (24), which carrier is mounted pivotably to the load arm (25) via a pivot bolt (54) and is mounted pivotably to the guiding arm (27) via a bearing bolt (63), and each carrier (31) receives at least one support arm (34) arranged pivotably thereon, so that the support arms (34) opposite one another are pivotable in a working space (50) formed at least between the lifting devices (24), wherein an angle of inclination is adjustable between the at least one support arm (34) and the lifting device (24).

19 Claims, 6 Drawing Sheets

(56) References Cited

U.S. PATENT DOCUMENTS

Figure 1:
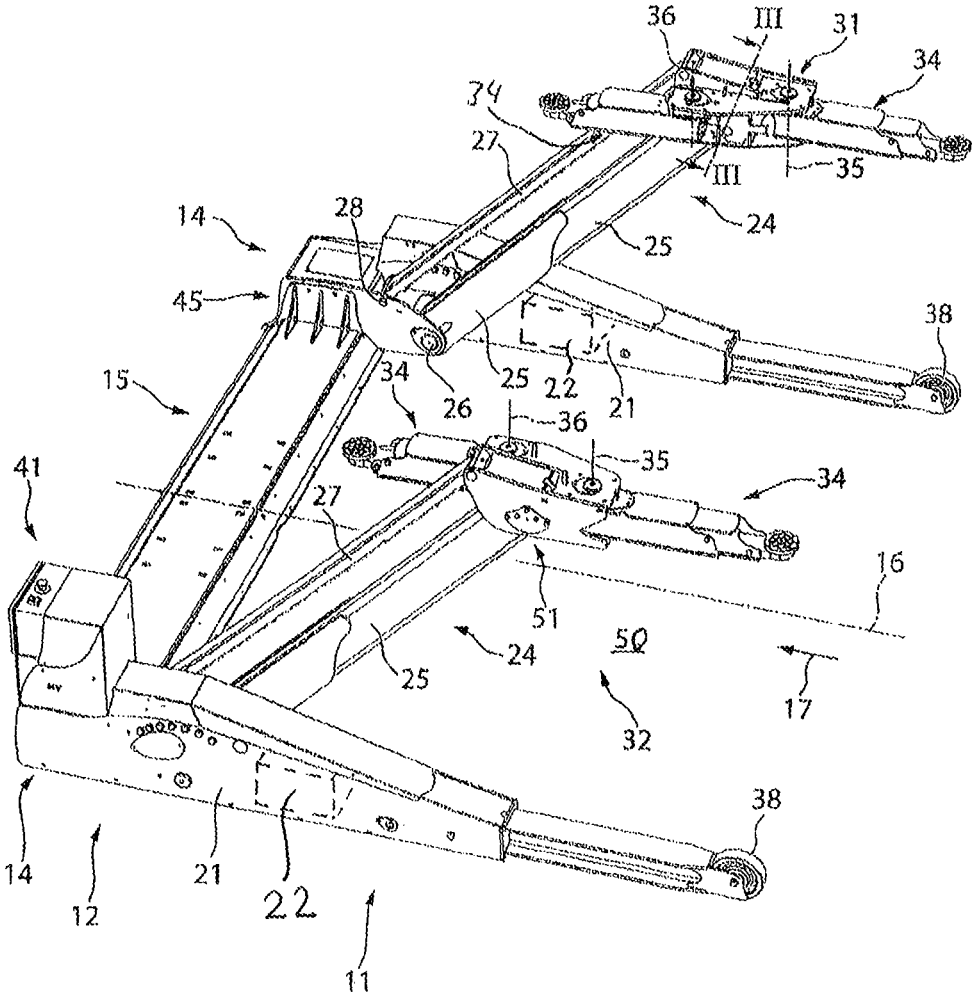

| | | | | |
|---|---|---|---|---|
| 4,798,266 | A | 1/1989 | Finkbeiner | |
| 4,825,977 | A * | 5/1989 | Isogai | B66F 7/02 187/206 |
| 5,025,892 | A | 6/1991 | Stelzl | |
| 6,213,451 | B1 * | 4/2001 | Finkbeiner | B66F 7/08 254/124 |
| 8,869,943 | B2 * | 10/2014 | Matthews | B66F 7/28 187/219 |
| 9,840,402 | B2 * | 12/2017 | Horimizu | B66F 7/28 |
| 2004/0011594 | A1 * | 1/2004 | Stewart | B66F 7/28 187/213 |
| 2012/0325587 | A1 * | 12/2012 | Matthews | B66F 7/28 187/216 |

FOREIGN PATENT DOCUMENTS

| | | | | |
|---|---|---|---|---|
| DE | 3830714 | A1 * | 3/1990 | B66F 7/18 |
| DE | 36 05 650 | C2 | 10/1994 | |
| DE | 202 07 646 | U1 | 8/2002 | |
| EP | 0 336 927 | A1 | 10/1989 | |
| JP | H04-91991 | U | 8/1992 | |
| JP | H09-156890 | A | 6/1997 | |
| JP | 2003-146594 | A | 5/2003 | |
| WO | WO-2011095283 | A1 * | 8/2011 | B25H 1/0007 |

* cited by examiner

LIFTING PLATFORM

The invention relates to a lifting platform for lifting vehicles.

DE 36 05 650 C2 discloses a mobile hydraulic lifting platform for lifting vehicles in overhead. This movable lifting platform includes a base assembly which rests stationary when lifting vehicles. When not in operation, this lifting platform can be moved, by means of a chassis, into a further operating or storage position. The base assembly of the lifting platform includes two base assembly halves, as well as a middle part, wherein the two base assembly haves are fixedly connected with one another and arranged to one another via the middle part. Each base assembly half comprises a drive, by means of which a parallelogram guiding device of the base assembly half is moveable up and down. This parallelogram guiding device includes a load arm and a guiding arm so that a carrier arranged on the free end region remains horizontally oriented in the raising and lowering of the parallelogram guiding device. The carrier provided on the parallelogram guiding device receives two support arms pivotably arranged on the carrier. These support arms can be pivoted out of a non-use position, in which the support arms are oppositely oriented and are positioned parallel to the parallelogram guiding device, into a use position, in order to lift up a vehicle entered between the base assembly halves and the lifting platform.

Each base assembly half is fastened to the middle part, which is configured in the form of a protective tube. The middle part comprises a flange portion on the respective end, which portion is screwed to a lateral surface of the housing of the base assembly half.

Due to dimensional tolerances, an orientation of the support arms differing from one another in an operating position inside the working space, in which the vehicle is lifted up, can be the case after the assembly. A readjustment or setting via the connecting point between the base assembly half and the middle part is difficult and only possible to a limited extent.

The object underlying the invention is to provide a lifting platform in which the support arms are orientable to one another in a simple way.

This object is achieved by a lifting platform, in which an angle of inclination between the support arm and the lifting device is adjustable. The support arms opposite one another can thereby be oriented pivotably to one another, for example, in a common horizontal. The support arms opposite one another can also be oriented such that these are located slightly above the horizontal with their free ends so that, when receiving a load, the support arms are located near to the horizontal or in the horizontal, for example. By altering the angle of inclination between the support arm and the lifting device, an individual adapting of the at least one support arm of each base assembly half can occur, so that the support arm(s) arranged on a right lifting device is or are adjustable independently of the support arm(s) provided on a left lifting device.

It is preferably provided that an adjustment device is provided between the carrier and the lifting device or between the support arm and the carrier in order to adjust the angle of inclination between the support arm and the lifting device. An individual orientation of the at least one support arm can thereby be made possible, in particular when positioning the carrier with the at least one support arm in an operating position. The operational safety can be increased through the orientation of the support arms, in particular in a common horizontal.

According to a preferred embodiment of the lifting platform, it is provided that, by means of the adjustment device, the carrier is adjustable, for the orientation of the support arms, in the inclination to the pivot axis of the pivot bolt and/or to the bearing axis of the bearing bolt, or to both. The pivot axis and the bearing axis on the one lifting device are oriented parallel to one another. This pivot and bearing axes of the one lifting device preferably align with the pivot and bearing axes of the opposite parallelogram guiding device. The adjustment of inclination of the carrier occurs to the effect that the carrier is rotatable or tiltable about its longitudinal axis. The longitudinal axis of the carrier extends orthogonally to the pivot axis of the pivot bolt and the bearing axis of the bearing bolt. Through the inclination of the carrier, a free end of the support arm, which end is pivoted into the working space, can be alterable in the height with respect to the floor, whereby an orientation of the support arms assigned to each other, in particular in a common horizontal, is made possible.

The adjustment device preferably includes a compensation plate with a borehole, which is placeable on an end of the pivot bolt or of the bearing bolt and is fastenable on or in the carrier. By means of this compensation plate, the carrier can be arrangeable in a zero point position, that is orthogonally to the parallelogram guiding device, or in a position rotated or tilted to the pivot axis or to the bearing axis. In this rotated or tilted position, a few angular degrees are already sufficient in order to effect an orientation of the support arms.

The carrier of the moveable lifting platform advantageously comprises at least two lateral walls spaced parallel to one another, which in each case comprise a perforation for the pivot bolts and the bearing bolts. In place of the perforation, a centering receptacle is provided in one of the two lateral walls, in which receptacle the compensation plate, which plate receives the pivot bolts or bearing bolts, can be inserted, and is supported in the lateral wall. The carrier, with respect to the positioning of the pivot bolt or bearing bolt in the one lateral wall of the carrier thereby remains at the same height to the pivot or bearing axis, and the opposite lateral wall of the carrier can take a greater or lesser distance relative to the pivot or bearing axis. This rotational or tilting movement of the carrier effects the adjustment of the free end of the carrier in the height to the floor or to the opposite carrier. Preferably, taking the greater or smaller distance to the pivot or bearing axis is provided on an outer side of the carrier, that is the side which lies remote to a longitudinal center axis of the lifting platform.

Moreover, it is preferably provided that the centering receptacle in the lateral wall is configured V-shaped or trough-shaped, narrows in a load direction and that the compensation plate comprises a complementary external contour, so that said contour rests form-fittingly in the centering receptacle. It is thereby ensured, in a loading of the lifting platform, that the force to be received, which force is introduced into the carrier via the support arms and is diverted from the carrier via the bolts in the parallelogram guide, can be securely introduced, by the compensation plate, into the lateral wall via the centering receptacle.

A further preferred configuration of the lifting platform provides that a retaining device is provided for fixation of the compensation plate in the centering receptacle, which device is detachably provided on a lateral wall, in particular on an external side of the lateral wall. A good accessibility and a simple mounting and unmounting of the retaining device, as well as a simple exchanging of a compensation plate are thereby made possible in order to set different angles of inclination.

Preferably, the retaining device is configured as a retaining plate, which includes at least one detachable fastening element, by means of which the retaining plate is fastenable with the lateral wall. Preferably, at least one retaining element is provided, through which the compensation plate is detachably fixated to the retaining plate. Moreover, a fixation element is preferably provided, through which the retaining plate is detachably fixable to the pivot bolt or bearing bolt. Preferably, the at least one fastening element, retaining element and fixation element engage on the retaining plate of the at least one fastening element. All components are thereby secured to one another.

Moreover, it is preferably provided that the retaining plate completely covers the centering receptacle in the lateral wall in the mounted position. A substantially closed lateral wall of the carrier can thereby be achieved, whereby a risk of injury is diminished.

Advantageously, multiple compensation plates are provided for one adjustment device, which plates deviate from one another in the distance between a reference surface provided on the compensation plate and a longitudinal center axis of the borehole. An alteration in the angle of inclination of the carrier to the pivot axis or bearing axis can thereby be adjusted. Preferably, markings or information are provided on the compensation plates, in order to signal to the user the respective distance which is adjustable using this compensation plate.

A further preferred embodiment of the lifting platform provides that the pivot bolt and the bearing bolt are rotatably received, by means of a radial bearing, about a stationary pivot and bearing axis, to the load arm and guiding arm. It is thereby made possible that the carrier is rotated about its longitudinal axis only by means of the adjustment device, that means that this carrier can be altered, clockwise and counterclockwise, to the longitudinal center axis of the lifting platform, in its position.

A preferred embodiment of the lifting platform provides that a base assembly, stationary in the lifting of vehicles, is provided, which assembly includes two base assembly halves, which are fixedly arranged to one another, via at least one preferably detachable connecting point, with a middle part.

Moreover, it is provided, in an advantageous configuration of the lifting platform, that a lifting device, in particular a parallelogram guiding device or a scissoring guide device, is arranged on each base assembly half, which device preferably includes a load arm and a guiding arm which, by means of at least one drive arranged on or in the at least one base assembly half, are transferrable out of a starting position arranged on the floor into an operating position, and which receives a carrier respectively in an end region of the lifting device, in particular of the parallelogram guiding device or the scissoring guide device, which carrier is mounted pivotably to the support arm via a pivot bolt and is mounted pivotably to the guiding arm via a bearing bolt, and each carrier receives at least one support arm pivotably arranged thereon, so that the support arms opposite one another are pivotable in a working space formed at least between the lifting devices, in particular parallelogram guiding devices or between the scissoring guide devices.

The lifting platform is configured in particular as a moveable lifting platform, so that this platform is positionable at the respective use site.

Figure 2:
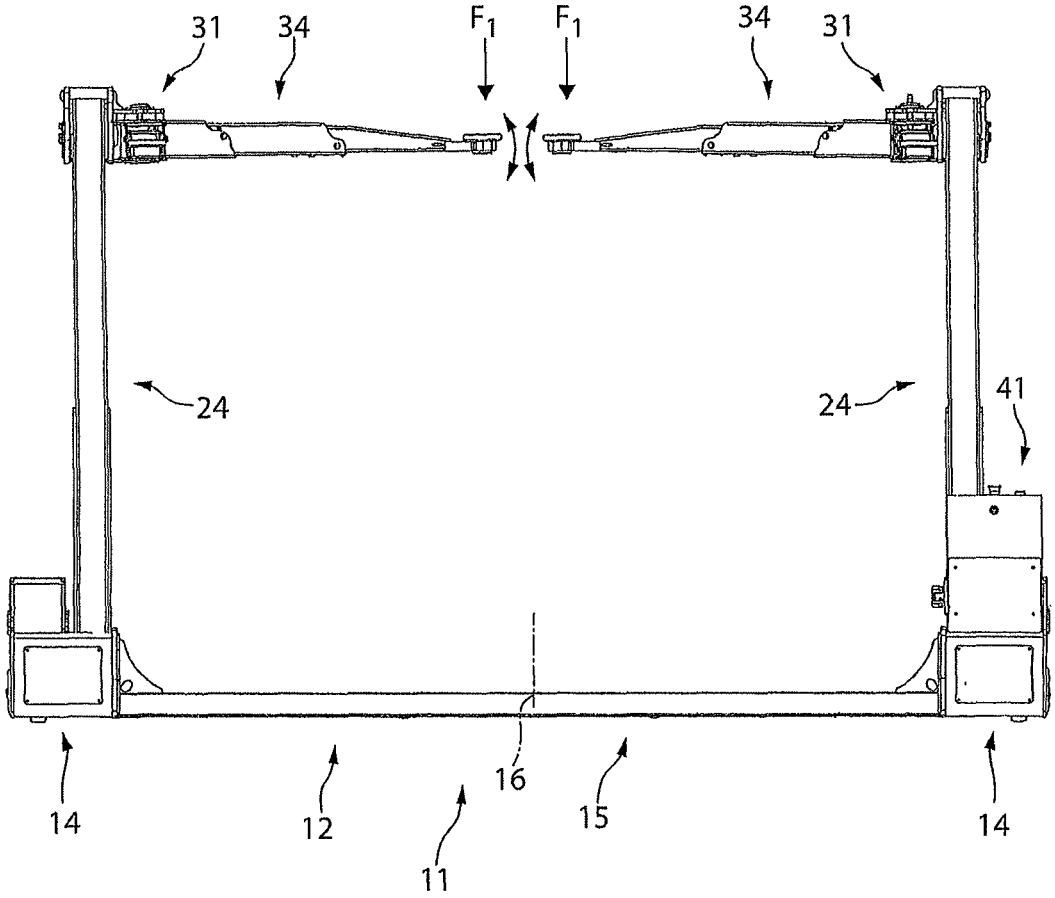
Figure 3:
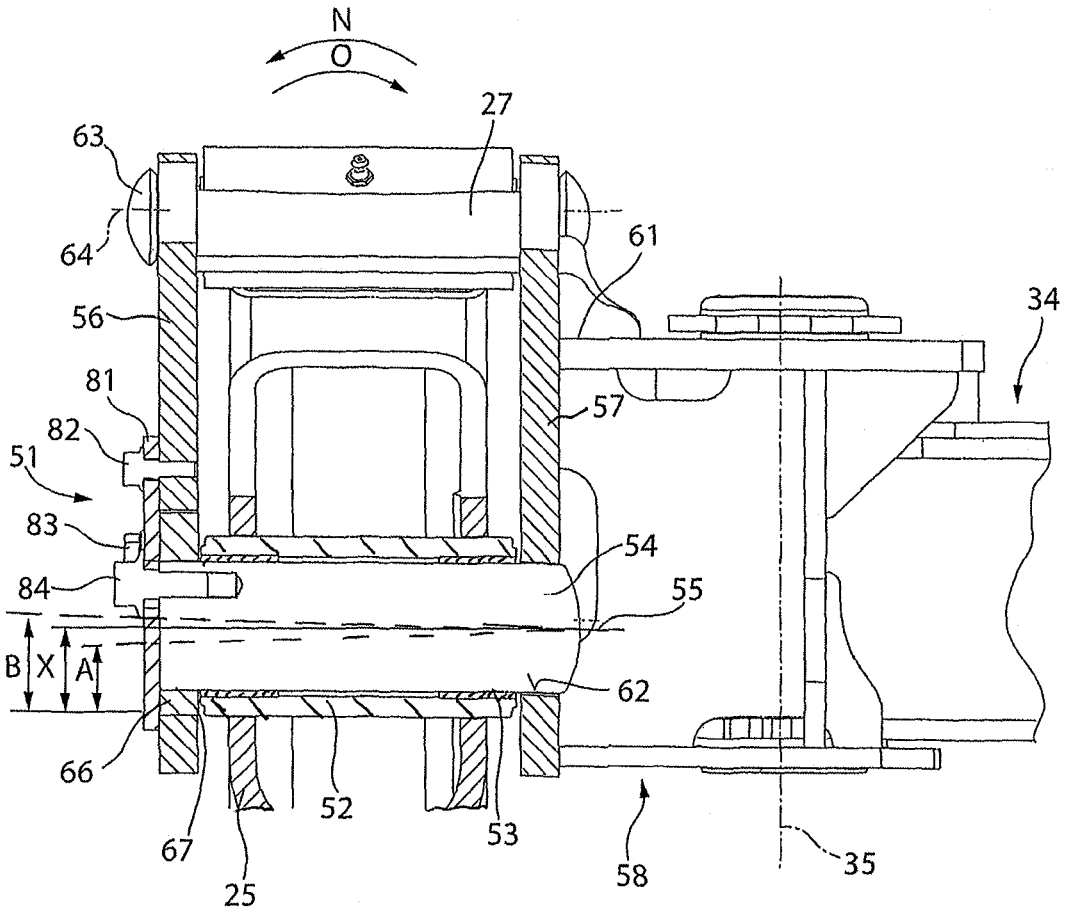
Figure 4:
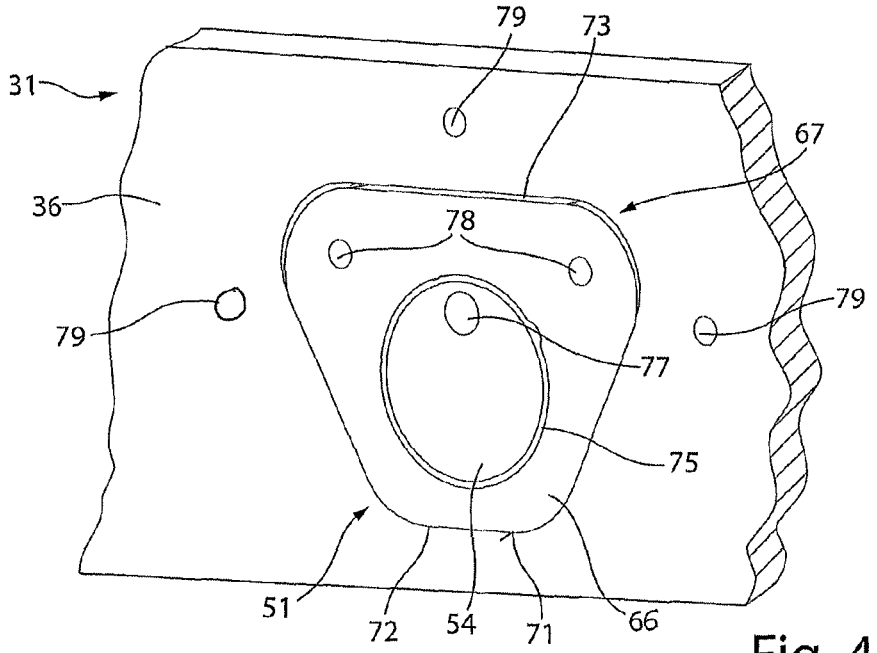
Figure 5:
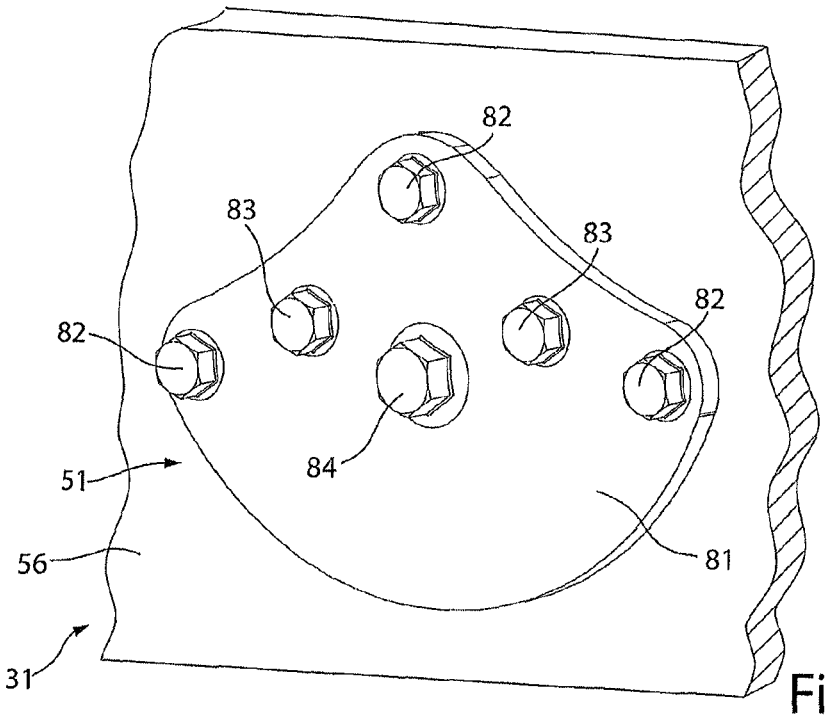
Figure 6A:
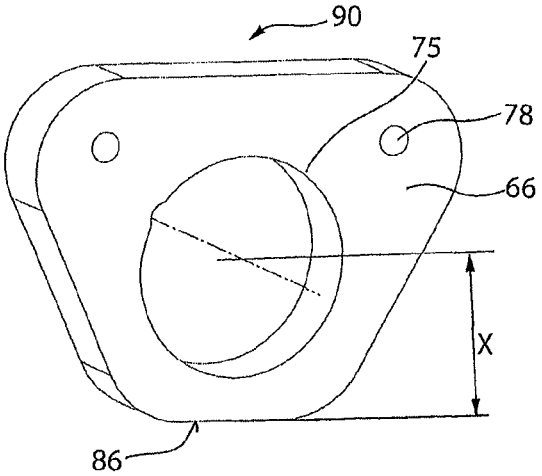
Figure 6B:
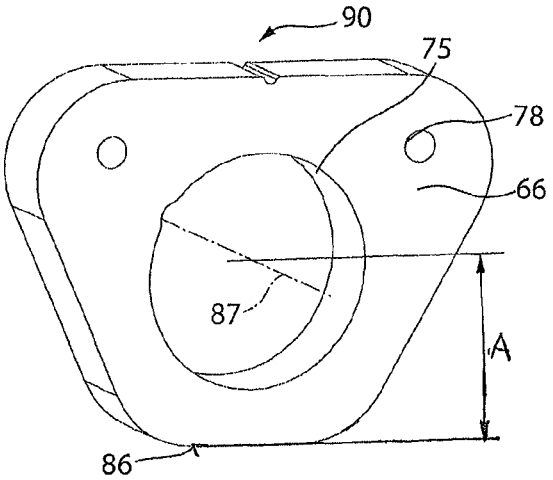
Figure 6C:
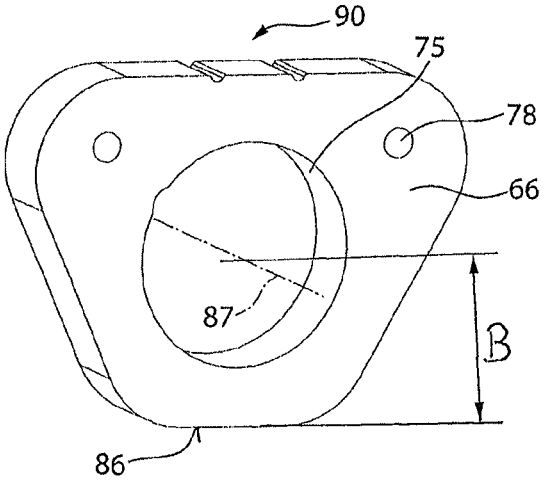
Figure 7:
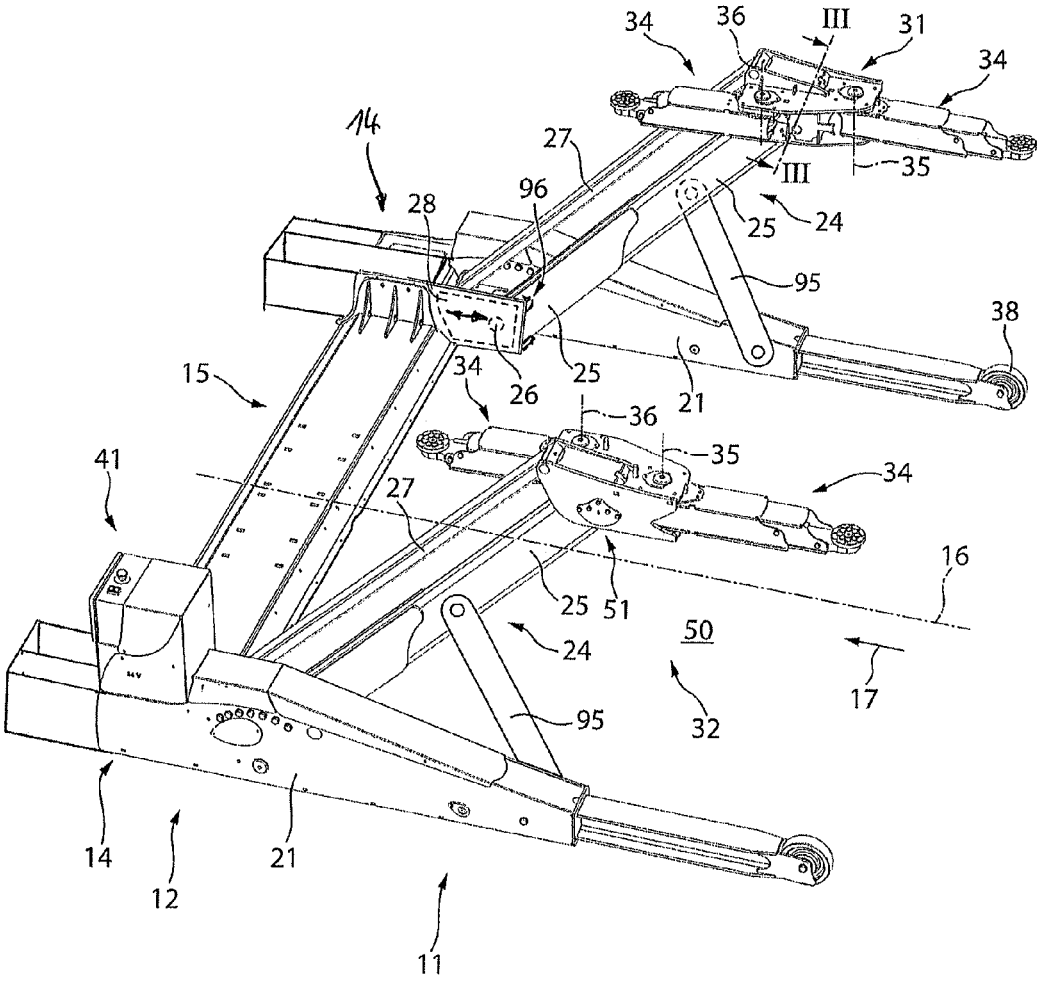

The invention, as well as further advantageous embodiments and further developments of the same are described in further detail and explained in the following based on the examples illustrated in the drawings. The features to be taken from the description and the drawings can be applied according to the invention individually or multiply in any combination. Shown are in:

FIG. 1 a perspective view of the lifting platform according to the invention, FIG. 2 a schematic front view onto the lifting platform according to FIG. 1, FIG. 3 a schematic partial section along the line III-III in FIG. 1, FIG. 4 a schematic view onto a mounting position of the adjustment device according to FIG. 3, FIG. 5 a schematic side view onto an adjustment device on the carrier, FIGS. 6*a* to 6*c* perspective views onto compensation plates of the adjustment device, different from one another, according to FIG. 4 and FIG. 7 a perspective view of an alternative embodiment of the lifting platform to FIG. 1.

FIG. 1 shows a perspective view of a lifting platform 11 according to the invention. This lifting platform 11 includes a base assembly 12 which includes two base assembly halves 14 and a middle part 15 arranged therebetween. Through the middle part 15, the base assembly halves 14 are preferably distanced and oriented parallel to one another. By means of the base assembly halves 14 and the middle part 15, a U-shaped base assembly 12 is formed. The open region constitutes an entry region in a working space 50 for a vehicle, which enters for so long until this vehicle is positioned near the middle part 12. The entry direction is illustrated according to arrow 17 in the perspective view of the lifting platform 11 in FIG. 1. The entry direction lies in the region of a longitudinal center axis 18 of the lifting platform 11. The longitudinal center axis 18 extends parallel between the two base assembly halves 14 and is arranged centrally thereto. The working space 50 extends at least between the two base assembly halves 14.

Each base assembly half 14 includes a housing 21, inside of which a schematically illustrated drive 22 is provided. Moreover, each base assembly half 14 receives a lifting device 24 which is configured, in this exemplary embodiment, as a parallelogram guiding device. Alternatively, the lifting device 24 can be configured as a scissoring guide device, in particular half-scissor, full scissor or double scissor. The at least one drive 22 lifts and lowers the lifting device 24. This lifting device 24 includes a load arm 25, which is pivotable about a first pivot axis 26. Moreover, the lifting device 24 includes a guiding arm 27, which is pivotable about a second pivot axis 28, which axis is distanced to the first pivot axis 26. Both pivot axes 26, 28 are mounted on the housing.

The lifting device 24 comprises a carrier 31 on an end region remote to the housing 21, which carrier remains oriented horizontally through the lifting device 24 during the raising and lowering of the lifting device 24. In FIG. 1, the lifting devices 24 are provided in an operating position 32. Such an operating position 32 can correspond to an overhead height. In a non-operating position, the lifting devices 24 are positioned oriented near the floor or resting upon the floor.

Each carrier 31 receives at least one support arm 34. Preferably, two support arms 34 are respectively provided on the carrier 31. These support arms 34 are pivotably mounted about in each case one pivot axis 35, 36. The support arms 34 can be configured to have the same length. Alternatively, the rear support arm facing towards the entry region can be configured longer than the in particular front support arm 34 facing towards the middle part 15. The support arms 34 are preferably configured as telescoping support arms.

The lifting platform 11 is preferably configured as a moveable lifting platform 11. Each base assembly half 14 preferably comprises a running roller 38 at an end remote to the middle part 15, which roller is part of a chassis. Moreover, a drawbar not illustrated in further detail can be fastenable, in a middle region, to the middle part 15, so that after lifting the middle part, the lifting platform 11 bis supported on an impeller of the drawbar and the two running rollers 38. The lifting platform 11 is thereby mobile and can be moveable to the respective use site. After the removal of the drawbar, this lifting platform 11 is stationary and rests on the floor.

Alternatively to the lifting platform 11 illustrated in FIG. 1, this platform can also be configured as a stationary lifting platform 11. In this case, the running rollers 38 can be dispensed with. In a stationary lifting platform 11, it can also be provided that this platform consists of the two base assembly halves 14 oriented towards one another. A middle part 15 can be provided or also be dispensed with.

A controller 41 is provided for the actuation of the lifting platform 11 out of a non-operating position into an operating position 32, which controller is for example arranged on one of the two base assembly halves 14. This controller 41 can output a control signal to the respective drive(s) 22. The drive 22 can be a hydraulic cylinder which is electrically actuatable. Preferably, a drive 22 is provided in each housing 21 of the base assembly half 14. The controller 41 includes monitoring sensors to for the synchronization of the lifting and lowering movement of the respective lifting device 24. Control lines can, on the one hand, be guided into the directly assigned base assembly half 14 by the controller 41. On the other hand, control lines can be guided inside the middle part 15 to the opposite base assembly half 14.

FIG. 2 illustrates a schematic front view onto the lifting platform 11 according to FIG. 1, in the operating position 32. The force acting on the support arms 34 is symbolized through the force F1, which force acts in a vehicle lifted in the operating position 32. To increase the operational safety, it is required that the at least two support arms 34 opposite one another are oriented nearly or in a common horizontal. A skewed positioning of the vehicle in the operating position 32 can thereby be prevented.

Due to dimensional tolerances of the first and second base assembly half 14, the case can arise that the support arm(s) 34 of the first base assembly half 14 and/or the support arm(s) 34 of the second base assembly half 14 are not oriented towards one another and/or lie outside of the horizontal. Here, the free ends of the support arms can be oriented above or below the horizontal.

At least one adjustment device 51 is provided on each base assembly half 14, through which device the inclination of the least one support arm 34 of the lifting device 24 is adjustable. Preferably, an angle of 90° is provided between the at least one support arm 34 and the lifting device 24. Insofar as the lifting device 24 is oriented in an elevated position outside of the vertical, however, the setting of the inclination of the at least one support arm 34 is required, so that this arm, in turn, is oriented in the horizontal.

According to a preferred embodiment, the adjustment device 51 is provided between the carrier 31 and the lifting device 24. The adjustment device 51 is preferably provided on an external side of the carrier 31. This device can also be provided on an internal side of the carrier 31.

FIG. 3 illustrates a schematic sectional view along the Line III-III in FIG. 1. This schematic partial section extends through an upper end region of the lifting device 24, as well as a part of the carrier 31.

A bearing bush 52 is provided in the upper end region of the load arm 25, which bush receives a radial bearing 53, through which a pivot bolt 54 is pivotably mounted about a pivot axis 55, with respect to the load arm 25. The carrier 31 comprises at least a first lateral wall 56 and a second lateral wall 57, which are preferably distanced parallel to one another. The first lateral wall 56 forms an external side of the carrier 31. The second lateral wall 57 forms an internal side of the carrier 31. A support arm bracket 58 is provided on this second lateral wall 57, which bracket pivotably receives the support arm 34 about a bearing axis 35, 36. The two lateral walls 56, 57 are kept at a distance to one another by means of a head plate 61.

The carrier 31 is connected with the guiding arm 27, remote to the pivot bolt 54, by means of a bearing bolt 63. The guiding arm 27 is thereby pivotably mounted about the one bearing axis 64 of the bearing bolt 63. By means of receiving of the carrier 31, via the pivot bolt 54 and bearing bolt 63, the carrier 31 can be oriented horizontally during the lifting and lowering of the lifting device 24.

The adjustment device 51 acts, according to the preferred embodiment, between the pivot bolt 54 and the carrier 31. Alternatively, the adjustment device 51 can also be provided on the bearing bolt 63. Likewise, the adjustment device 51 can be provided on the pivot bolt 54, as well as on the bearing bolt 53. The structure of the adjustment device remains the same in the alternative embodiments.

The adjustment device 51 includes a compensation plate 66 which is positioned in a centering receptacle 67 in the lateral wall 56. This is illustrated in FIG. 4 in a side view. The centering receptacle 67 in the lateral wall 56 has a V- or trough-shaped contour 71 which tapers in a force direction according to Force F1. The centering receptacle 67 can be configured in a trapezoidal. A lower lateral edge 72 of the trapezoidal centering receptacle 67 is shorter than the opposite or upper lateral edge 73. The compensation plate 66 preferably has a complementary external contour. In a load acting on the support arms 34, the V- or trough-shaped region of the centering receptacle 67 is supported on the complementary region of the compensation plate 66, which region in turn transfers the force onto the pivot bolt 55.

The compensation plate 66 includes a borehole 75, into which an end of the pivot bolt 54 engages, insofar as compensation plate 66 is positioned in the centering receptacle 67.

The pivot bolt 54 comprises at least one borehole 77 on its end face. The compensation plate 66 likewise comprises at least one borehole 78. Outside of the compensation plate 76, at least one further borehole 79 is provided in the lateral wall 56.

FIG. 3 shows a retaining device 81 of the adjustment device 51 in a sectional view, which device in represented in an enlarged side view in FIG. 5. This retaining device 81 is configured as a retaining plate, which is fixedly connected with the lateral wall 56 by means of at least one detachable fastening element 82, in particular a screw, in that the at least one fastening element 82 engages into the borehole 79. Moreover, it is preferably provided that at least one detachable retaining element 83, in particular a screw, is provided for fixation of the compensation plate 66 to the retaining device 81, which screw engages into the at least one borehole 78. Advantageously, at least one detachable fixation element 84, in particular a screw, is provided, which engages into at least one borehole 77 of the pivot bolt 55. It is thereby made possible that the adjustment device 51 allows for a firm connection between the carrier 31 and the lifting device 24.

The adjustment device 51 illustrated in the FIGS. 3 to 5 allows for adjusting the carrier 31, to the lifting device 24, in a zero point position. The lateral walls 56, 57 are oriented perpendicular to the pivot axis 55. The pivot bolt 54 and bearing bolt 63 are respectively mounted in a perforation 62 in the lateral wall 56, 57, insofar as no adjustment device 51 is provided. The borehole 75 in the compensation plate 66 is arranged inside the compensation plate 66 in such a manner that the distance X according to FIG. 3 can be assumed. The distance X corresponds to a distance which is defined by the reference surface 86 of the compensation plate 66 and a longitudinal axis 87 of the borehole 75, as can be taken from FIG. 6*a*.

Insofar as the support arm 34 now inclines in direction onto the floor and lies below the horizontal, in the use of a compensation plate 66 for a zero position, the compensation plate 66 can be exchanged according to FIG. 4*a* and be employed by means of a compensation plate 66 according to FIG. 6*b*. In this compensation plate 66, a distance A is provided between the reference surface 86 and the longitudinal axis 87 of the borehole 75, which is smaller in distance than the distance X. The carrier 31 is thereby pivoted in a direction according to arrow N, wherein the lateral wall 57, to the pivot bolt 54, forms a kind of rotary bearing, in order to effect the pivoting movement of the carrier 31 to the pivot bolt 55.

The exchange of the compensation plate 66 occurs to the effect that the fastening elements 82, retaining elements 83 and fixation elements 84 provided on the retaining device 81 are detached, as well as the retaining plate being removed. Subsequent thereto, the compensation plate 66 is taken out of the centering receptacle 67 and the desired new compensation plate 66, in turn, is placed upon the pivot bolt 54 and inserted into the centering receptacle 67. The retaining device 81 is, in turn, affixed with the at least one fastening element 82, retaining element 83 and fixation element 84. The new orientation of the support arm 34 is fixed.

Insofar as the end of the support arm 34 lies above a horizontal, originating from the adjustment device 51, with a zero position, it is necessary to lower the free end of the support arm 34. In such a case, a compensation plate 66 can be used according to FIG. 6*c*, in which the distance B between the reference surface 86 and the longitudinal axis 86 of the borehole 75 is greater than the distance X. Thereafter, the carrier 31 is inclined in the direction of arrow O and the free end of the support arm 34 is lowered.

The adjustment device 51 is preferably provided with multiple compensation plates 66, which have different distances between the reference surface 86 and the longitudinal axis 87, in order to make an individual adjusting and adapting of the support arms 34 possible.

The compensation plates 66 can comprise markings 90, through which these plates can be differentiated from one another. For example, these can be indentations, as these are illustrated in FIGS. 6*b* and 6*c*. Likewise, numbers or other symbols can be applied. Colored markings are also possible.

FIG. 7 illustrates an alternative configuration of the lifting platform 11 with respect to FIG. 1. This lifting platform 11 is different to the embodiment in FIG. 1 with respect to the configuration of the lifting device 24. In FIG. 1, the lifting device 24 is configured as a parallelogram guiding device. In the embodiment in FIG. 7, the lifting device 24 is configured as a half scissor. This half scissor comprises a strut 95 which, on the one hand, is pivotably mounted on the load arm 25 and, on the other hand, is pivotably mounted on the housing 21 of the base assembly half 14. The carrier 31 is guided oriented horizontally in this half scissor through the load arm 25 and the guiding arm 27. An opposite end of the load arm 25 and of the guiding arm 27 is pivotably mounted in a moveable carriage 96. This moveable carriage 96 is illustrated in a dashed-line manner. This moveable carriage 96 is guided horizontally movably through the housing 21 of the base assembly half 14.

The invention claimed is:

1. A lifting platform for lifting vehicles, comprising:

two base assembly halves, each base assembly half comprising a lifting device arranged thereon, in which the respective lifting devices are spaced apart from each other in a lateral direction with a working space formed between the lifting devices, each lifting device being transferable by at least one drive between a starting position that is near or on the floor and an operating position that is at a higher elevation than the starting position, each lifting device comprises a carrier at an end region of the lifting device, each carrier includes at least one support arm arranged pivotably thereon, so that the respective at least one support arms of the carriers are opposite one another on opposite sides of a vertical plane that passes between the two base assembly halves and bisects the working space in a longitudinal direction that is perpendicular to the lateral direction, wherein the at least one support arms of each respective carrier is rotatable about a respective vertical rotation axis into the working space and toward or away from the vertical plane, and wherein each respective at least one support arm is arranged on its respective carrier with an adjustable angle of inclination such that the vertical rotation axis of each at least one support arm is tiltable toward or away from the vertical plane so as to enable tilting of each respective at least one support arm relative to the floor and toward or away from the vertical plane in the working space.

2. The lifting platform according to claim 1, wherein an adjustment device for adjusting the angle of inclination is provided for each base assembly half, the adjustment device being between the respective carrier and the respective lifting device and/or between the respective carrier and the respective at least one support arm.

3. The lifting platform according to claim 2, wherein, each carrier is adjustable, by means of the respective adjustment device, for orienting each respective at least one support arm, in the inclination to a pivot axis of a respective pivot bolt or to a bearing axis of a respective bearing bolt, or to both.

4. The lifting platform according to claim 3, wherein each adjustment device comprises a compensation plate with a borehole, which is placeable on an end of the pivot bolt or the bearing bolt and is fastenable on or in the carrier, through which a zero-point position or inclination of the respective carrier to the pivot bolt or bearing bolt or both is adjustable.

5. The lifting device according to claim 4, wherein a retaining device is provided for fixating the compensation plate in the centering receptacle, which device is provided detachably on the lateral wall.

6. The lifting platform according to claim 5, wherein the retaining device is configured as a retaining plate which receives at least one detachable fastening element, through which the retaining device is fixated on the lateral wall.

7. The lifting platform according to claim 5, wherein the retaining device receives at least one retaining element for fixation of the compensation plate to the retaining device.

8. The lifting platform according to claim 5, wherein the retaining device receives at least one fixation element for detachable fastening of the retaining device to the pivot bolt or the bearing bolt.

9. The lifting platform according to claim 5, wherein the retaining device configured as a retaining plate completely covers the centering receptacle in a position fastened to the lateral wall.

10. The lifting platform according to claim 4, wherein the adjustment device includes multiple compensation plates which deviate from one another in the distance between a reference surface provided on the compensation plate and a longitudinal axis of the borehole.

11. The lifting platform according to claim 4, wherein the pivot bolt and the bearing bolt are rotatably arranged, by means of a radial bearing, about a pivot axis and bearing axis, stationary to the load arm and guiding arm.

12. The lifting platform according to claim 1, wherein a base assembly, stationary in the lifting of vehicles, is provided, which assembly includes the two base assembly halves, which are arranged fixedly to one another via at least one connecting point, with a middle part.

13. The lifting platform according to claim 12, wherein the two base assembly halves are arranged to one another via at least one detachable connection point with the middle part.

14. The lifting device according to claim 1, wherein each lifting device of the two base assembly halves further comprises a respective load arm having a first end portion pivotably mounted to the respective base assembly half about a respective horizontal pivot axis, the respective load arms each extending from the first end portion to a second end portion of the load arm along a respective longitudinal axis that is transverse to the respective horizontal pivot axis, the respective load arms each being pivotable about the respective horizontal pivot axis by the at least one drive which raises or lowers the second end portion of the respective load arm relative to ground, and wherein the respective carriers of the lifting devices are each mounted to the respective second end portion of the respective load, each respective carrier including two support arms that are each rotatable about respective vertical rotation axes to rotate the two support arms into the working space, wherein the respective vertical rotation axes of the two support arms of each carrier are offset from the respective horizontal pivot axis in the same longitudinal direction starting from the respective horizontal pivot axis, such that both of the vertical rotation axes of each carrier are on the same side of a lateral plane that extends through each horizontal pivot axis of the respective base assembly half, and which the lateral plane is perpendicular to the vertical plane that bisects the working space.

15. The lifting device according to claim 1, wherein each lifting device of the two base assembly halves further comprises a respective load arm that is transferable by the at least one drive between the starting position that is near or on the floor and the operating position that is at a higher elevation than the starting position, and pivotable about the respective horizontal pivot axis by the at least one drive which raises or lowers the second end portion of the respective load arm relative to ground, and wherein the working space is formed between the first and second load arms, and occupies a volume that (i) extends in the lateral direction which extends parallel to ground between the first and second load arms, (ii) extends in the longitudinal direction which is parallel to ground and perpendicular to the lateral direction, and (iii) extends in a vertical direction that is perpendicular to ground.

16. The lifting device according to claim 1, wherein the at least one drive includes at least two drives, and wherein each assembly half includes one of the at least two drives for raising or lowering the respective lifting device.

17. A lifting platform for lifting vehicles, comprising:

two base assembly halves, each base assembly half comprising a lifting device arranged thereon, in which the respective lifting devices are spaced apart from each other in a lateral direction with a working space formed at least between the lifting devices, each lifting device being transferable by at least one drive between a starting position that is near or on the floor and an operating position that is at a higher elevation than the starting position, each lifting device comprises a carrier at an end region of the lifting device, each carrier includes at least one support arm arranged pivotably thereon, so that the respective at least one support arms of the carriers are opposite one another across the working space, wherein each respective at least one support arms is rotatable about a respective vertical rotation axis into the working space, and wherein each respective at least one support arm is arranged on its respective carrier to tilt toward or away from the opposite at least one support arm of the other base assembly half by a tilting angle;

wherein each base assembly half includes an adjustment device that is configured to adjust the tilting angle of the respective at least one support arm;

wherein each adjustment device comprises a compensation plate with a borehole, which is placeable on an end portion of a pivot bolt or a bearing bolt and is fastenable on or in the respective carrier, through which a zero-point position or inclination of the respective carrier to the pivot bolt or bearing bolt or both is adjustable; and wherein each carrier includes at least two lateral walls distanced to one another, which walls respectively comprise a perforation for the respective pivot bolt or the respective bearing bolt or both, and in that, in one of the lateral walls, at least one centering receptacle is provided, into which the respective compensation plate is insertable.

18. The lifting platform according to claim 17, wherein the centering receptacle, in the lateral wall, has a V- or trough-shaped contour, narrows in a load direction, and the compensation plate has a complementary external contour and rests form-fittingly in the contour of the centering receptacle.

19. A lifting platform for lifting vehicles, comprising:

a first base assembly half having a first lifting device that includes a first load arm, and a second base assembly half having a second lifting device that includes a second load arm, the first and second load arms being spaced apart from each other in a lateral direction that is parallel to ground, in which a working region is formed between the first and second load arms, the working region occupying a volume that (i) extends in the lateral direction between the first and second load arms, (ii) extends in a longitudinal direction that is parallel to ground and perpendicular to the lateral direction, and (iii) extends in a vertical direction that is perpendicular to ground;

the first lifting device being arranged on the first base assembly half, the first lifting device comprising:

the first load arm having a first end portion pivotably mounted to the first base assembly half about a first horizontal pivot axis, the first load arm extending from the first end portion to a second end portion of the first load arm along a first longitudinal axis that is transverse to the first horizontal pivot axis, the first load arm being pivotable about the first horizontal pivot axis by at least one drive that raises or lowers the second end portion of the first load arm relative to ground, in which the raising or lowering of the second end portion of the first load arm is within a first vertical plane that extends in the vertical direction and includes the first longitudinal axis, and a first carrier mounted to the second end portion of the first load arm that is opposite the first end portion of the first load arm, the first carrier including at least two first support arms that are each rotatable about respective first vertical rotation axes to rotate the two first support arms into the working region between the first and second load arms, wherein the respective first vertical rotation axes are both offset from the first horizontal pivot axis in the same longitudinal direction starting from the first horizontal pivot axis, such that both of the first vertical rotation axes are on the same side of a lateral plane that extends in the lateral direction through the first horizontal pivot axis;

wherein an angle of inclination of the at least two first support arms is adjustable such that the respective first vertical rotation axes are tiltable toward or away from the second base assembly half so as to enable tilting of the at least two first support arms relative to the ground and relative to the first vertical plane; and the second lifting device being arranged on the second base assembly half, the second lifting device comprising:

the second load arm having a first end portion pivotably mounted to the second base assembly half about a second horizontal pivot axis, the second load arm extending from the first end portion to a second end portion of the second load arm along a second longitudinal axis that is transverse to the second horizontal pivot axis, the second load arm being pivotable about the second horizontal pivot axis by the at least one drive that raises or lowers the second end portion of the second load arm relative to the ground, in which the raising or lowering of the second end portion of the second load arm is within a second vertical plane that extends in the vertical direction and includes the second longitudinal axis, and a second carrier mounted to the second end portion of the second load arm that is opposite the first end portion of the second load arm, the second carrier including at least two second support arms that are each rotatable about respective second vertical rotation axes to rotate the two second support arms into the working region between the first and second load arms, wherein the respective second vertical rotation axes are both offset from the second horizontal pivot axis in the same longitudinal direction starting from the second horizontal pivot axis, such that both of the second vertical rotation axes are on the same side of the lateral plane that extends in the lateral direction through the first horizontal pivot axis and the second horizontal pivot axis;

wherein an angle of inclination of the at least two second support arms is adjustable such that the respective second vertical rotation axes are tiltable toward or away from the first base assembly half so as to enable tilting of the at least two second support arms relative to the ground and relative to the second vertical plane.

* * * * *